US008093832B2

(12) United States Patent
Jang

(10) Patent No.: US 8,093,832 B2
(45) Date of Patent: Jan. 10, 2012

(54) BACKLIGHT UNIT WITH REDUCED INVERTER NOISE AND LIQUID CRYSTAL DISPLAY APPARATUS HAVING THE SAME

(75) Inventor: Hyeon-Yong Jang, Osan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 652 days.

(21) Appl. No.: 12/234,074

(22) Filed: Sep. 19, 2008

(65) Prior Publication Data

US 2009/0108774 A1 Apr. 30, 2009

(30) Foreign Application Priority Data

Oct. 31, 2007 (KR) ..... 10-2007-0110343

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 39/02* | (2006.01) |
| *H05B 41/16* | (2006.01) |
| *H05B 41/24* | (2006.01) |
| *H05B 37/00* | (2006.01) |
| *H05B 39/00* | (2006.01) |
| *H05B 41/00* | (2006.01) |
| *G09G 3/36* | (2006.01) |

(52) U.S. Cl. ..... 315/294; 315/209 R; 315/210; 315/219; 315/246; 315/276; 315/291; 315/312; 315/323; 345/102

(58) Field of Classification Search ..... None
See application file for complete search history.

(56) References Cited

U.S. PATENT DOCUMENTS

2007/0018942 A1* 1/2007 Ooyama ..... 345/102
2008/0001911 A1* 1/2008 Kim ..... 345/102

FOREIGN PATENT DOCUMENTS

JP 3898406 B2 * 3/2007

* cited by examiner

*Primary Examiner* — Douglas W Owens
*Assistant Examiner* — Dedei K Hammond
(74) *Attorney, Agent, or Firm* — F. Chau & Associates, LLC

(57) ABSTRACT

In a backlight unit and an LCD apparatus having the backlight unit, in which the backlight unit includes a plurality of lamps and an inverter, the inverter provides the lamps with current. The inverter reduces current provided to the lamps to turn off the lamps. Therefore, currents are gradually decreased to reduce noise generated by the transformer when the lamps are turned off.

13 Claims, 7 Drawing Sheets

BACKLIGHT UNIT WITH REDUCED INVERTER NOISE AND LIQUID CRYSTAL DISPLAY APPARATUS HAVING THE SAME

CROSS-REFERENCE TO RELATED APPLICATION

The present application claims priority to Korean Patent Application No. 2007-0110343, filed on Oct. 31, 2007, the disclosure of which is incorporated herein by reference in its entirety.

BACKGROUND OF THE INVENTION

1. Technical Field

The present disclosure relates to a backlight unit and a liquid crystal display (LCD) apparatus having the backlight unit. More particularly, the present disclosure relates to a backlight unit capable of reducing noise produced by an inverter, and an LCD apparatus having the backlight unit.

2. Discussion of Related Art

As modern society becomes a more information-oriented society, an LCD apparatus, which is only one kind of display apparatus, becomes more important. A cathode ray tube (CRT), which had been mostly widely used, has merits such as high performance and low cost, but demerits such as large size and high power consumption. On the other hand, the LCD apparatus has demerits of high cost, but merits such as a small size, light weight, thin thickness, low power consumption, and the like. Therefore, the LCD apparatus has replaced the CRT.

The LCD apparatus includes an LCD panel and a backlight unit providing the LCD panel with light. The LCD panel displays an image by controlling transmittance of light provided by the backlight unit. The backlight unit includes a lamp and an inverter driving the lamp.

The lamp may be arranged at a side of a light guide plate disposed behind the LCD panel in order to provide the LCD panel with light. Alternatively, the lamp may be disposed under the LCD panel to directly provide the LCD panel with light. More specifically, in the case of an LCD panel with a large size screen, a plurality of lamps is disposed under the LCD panel to provide the LCD panel with light.

When the number of lamps increases, the power consumption also increases. In addition, motion blur may be generated when displaying a motion picture on an LCD panel.

A scanning method may be employed to sequentially drive a plurality of lamps, however, when the plurality of lamps is sequentially driven, luminance of the LCD panel is lowered due to a reduction of tube currents.

When the amount of currents increase, noise may be generated by the inverter at a time when light turns off.

SUMMARY OF THE INVENTION

Exemplary embodiments of the present invention provide a backlight unit capable of reducing noise generated by a transformer of an inverter by providing a sub-pulse signal in which a pulse width is smaller than a pulse width of a main pulse signal, in a turn-off period of a lighting control signal.

Exemplary embodiments of the present invention also provide an LCD apparatus having the backlight unit.

In an exemplary embodiment, a backlight unit includes a plurality of lamps and at least one inverter. The inverter provides the lamps with current. The inverter reduces the current provided to the lamps to turn off the lamps.

The lamps may be sequentially lit.

The inverter may include a transformer, a switching device part and a current controller. The transformer may boost a voltage applied to the transformer to generate a boosted voltage, and provide the lamps with the boosted voltage. The switching device part may convert an input voltage of a direct current into an output voltage of an alternating current to provide the transformer with the output voltage. The current controller may provide the switching device part with a logic signal.

The current controller may include a current control circuit outputting currents, in which a peak gradually increases or decreases in a transient period, and in which the peak is uniform in a normal period.

The backlight unit may further include an inverter control part providing the current controller with a lighting control signal sequentially lighting the lamps.

The light control signal may include a main pulse signal providing the lamps with maximum currents, a sub-pulse signal generated at a time point of turning off the lamps, the sub-pulse gradually decreasing currents provided to the lamps, and a silent period disposed between pulses of the main pulse signal and the sub-pulse signal.

A time, during which the main pulse is provided, may be inversely proportional to the number of lamps.

A pulse width of the sub-pulse is shorter than a pulse width of the main pulse.

The silent period and a time, during which the sub pulse is provided, are in a range of about 50 microseconds (μs) to about 100 μs. Lighting times for lamps adjacent each other may be overlapped with each other.

In an exemplary embodiment, an LCD apparatus includes an LCD panel, a backlight unit, a gate driving part, a data driving part and a timing controller. The backlight unit provides the LCD panel with light. The backlight unit includes a plurality of lamps and at least one inverter providing the lamps with current. The inverter reduces the current provided to the lamps to extinguish the lamps. The gate driving part and the data driving part drive the LCD panel. The timing controller provides the gate driving part and the data driving part with a gate control signal and a data control signal, respectively.

The LCD apparatus may further include an inverter control part outputting a lighting control signal for controlling a lighting time of each of the lamps.

The inverter may include a transformer, a switching device part, and a current controller. The transformer may boost a voltage applied to the transformer to generate a boosted voltage, and provide the lamps with the boosted voltage. The switching device part may convert an input voltage of a direct current into an output voltage of an alternating current and provide the transformer with the output voltage. The current controller may provide the switching device part with a logic signal.

The gate control signal may include a gate start pulse. The timing controller may provide the inverter control part with the gate start pulse. The inverter control part may provide the inverter with a lighting control signal, synchronized with the gate start pulse.

The lighting control signal may include a main pulse providing the lamps with maximum currents, a sub-pulse generated at a time point of extinguishing the lamps, the sub-pulse gradually decreasing currents provided to the lamps, and a silent period disposed between the main pulse and the sub-pulse.

The silent period and a time, during which the sub-pulse is provided, are in a range of from about 50 microseconds (μs) to about 200 μs.

A time, during which the lighting control signal is provided, may be inversely proportional to the number of lamps.

The lamps may be sequentially lit, and each of the lamps may be lit at least once during one frame of the LCD panel.

In an exemplary embodiment, an LCD apparatus includes an LCD panel, a backlight unit, and an inverter. The backlight unit provides the LCD panel with the light needed to display an image. The backlight unit includes a plurality of lamps and an inverter driving the lamps. The inverter control part provides the inverter with a lamp lighting signal in order to sequentially drive the lamps. The inverter control part outputs the lamp lighting signal having a discontinuous square-wave shape for reducing currents provided to the lamps when the lamps are turned off.

The inverter generates a high-frequency current signal through the lamp lighting signal. The high-frequency current signal includes a transient response period of lighting, a normal response period, and a transient response period of turning off a lamp, and a current waveform of the transient response period of lamp lighting and a current waveform of the transient response period of turning off a lamp are symmetric with respect to each other.

According to an exemplary embodiment of the present invention, currents are gradually decreased to reduce noise generated by the transformer when the lamps are turned off.

Additionally, power consumption and visibility deficiencies, such as motion blur, may be reduced, because the lamps are disposed under the LCD panel and the lamps are sequentially driven.

Furthermore, the luminance of the LCD apparatus may be enhanced by increasing currents provided to the lamps.

BRIEF DESCRIPTION OF THE DRAWINGS

Exemplary embodiments of the present invention will be understood in more detail from the following descriptions taken in conjunction with the accompanying drawings, in which.

DESCRIPTION OF THE EXEMPLARY EMBODIMENTS

Detailed operations and exemplary embodiments of the invention are described more fully hereinafter with reference with the accompanying drawings. The present invention may, however, be embodied in many different forms and should not be construed as limited to the exemplary embodiments set forth herein.

Figure 1:
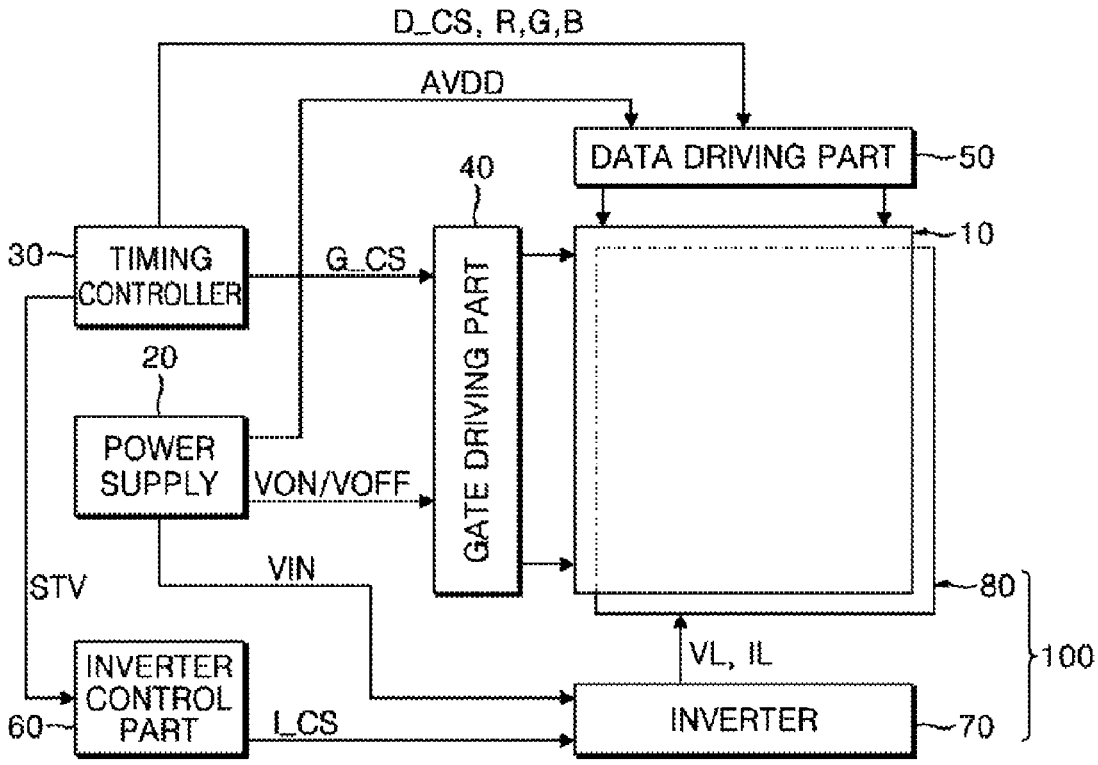
FIG. 1 is a block diagram illustrating an LCD apparatus according to an exemplary embodiment of the present invention.
Figure 2:
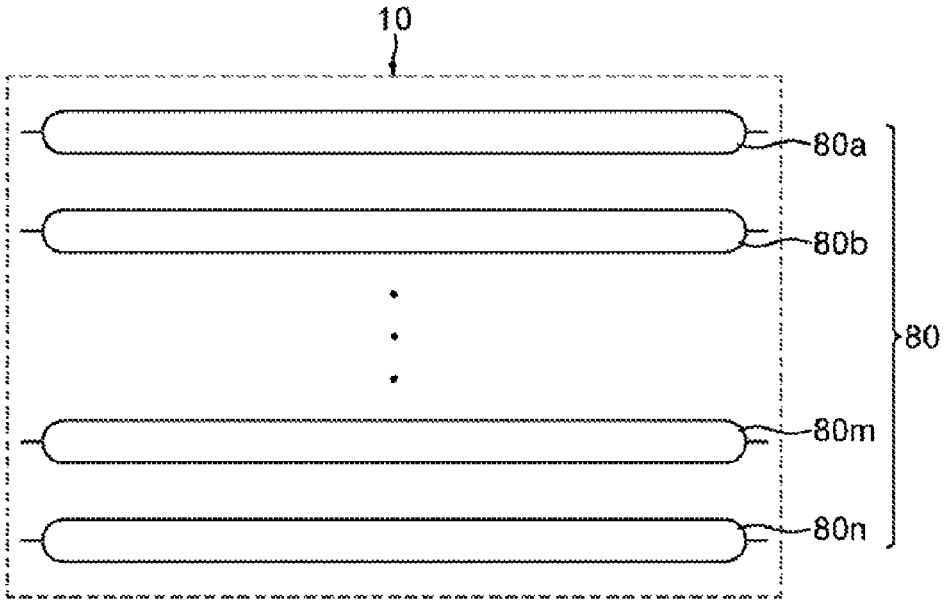
FIG. 2 is a plan view illustrating an arrangement of lamps in the LCD apparatus of FIG. 1.

FIG. 1 is a block diagram illustrating an LCD apparatus according to an exemplary embodiment of the present invention, and FIG. 2 is a plan view illustrating an arrangement of lamps in the LCD apparatus of FIG. 1.

Referring to FIG. 1, an LCD apparatus according to an exemplary embodiment of the present invention includes an LCD panel 10, a power supply 20, a timing controller 30, a gate driving part 40, a data driving part 50, an inverter control part 60, and a backlight unit 100.

The LCD panel 10 includes a plurality of gate lines (not shown), a plurality of data lines (not shown), a plurality of thin film transistors (TFTs) (not shown), and a plurality of pixel electrodes (not shown). The gate lines and the data lines cross each other. The LCD panel 10 displays an image according to a gate-on voltage VON provided through the gate lines and data voltage provided by the data lines.

The power supply 20 receives external voltage to generate driving voltages, such as the gate-on voltage VON, a gate-off voltage VOFF, an analog driving voltage AVDD, an input voltage VIN, and the like. The gate-on voltage VON and the gate-off voltage VOFF generated by the power supply 20 are applied to the gate driving part 40, and the analog driving voltage AVDD generated by the power supply 20 is applied to the data driving part 50.

The input voltage VIN is applied to the inverter 70 included in the backlight unit 100. The input voltage VIN may be, for example, in a range of about 20V to about 30V.

The timing controller 30 provides the data driving part 50 with data signals R, G, and B. provided by an external device (not shown). The timing controller 30 generates a gate control signal G_CS and a data control signal D_CS. The gate control signal G_CS generated by the timing controller 30 is applied to the gate driving part 40, and the data control signal D_CS generated by the timing controller 30 is applied to the data driving part 50.

The gate control signal G_CS includes a gate start pulse STV, a gate shift clock, an output control signal, and the like. The gate start pulse STV is a signal for informing a start of one frame and, although not shown, may be simultaneously applied to both the gate driving part 40 and the inverter control part 60.

The gate driving part 40 may sequentially apply the gate-on voltage VON and the gate-off voltage VOFF generated by the power supply 20 to the gate lines of the LCD panel 10 in accordance with the gate control signal G_CS provided by the timing controller 30.

The data driving part 50 may output data voltages converted to gray scale voltages corresponding to the data signals R, G, and B provided by the timing controller 30 in accordance with the data control signal D_CS.

The backlight unit 100 includes an inverter 70 and a lamp part 80. The backlight unit 100 provides the LCD panel 10 with light generated by the lamp part 80. When the backlight unit 100 provides the LCD panel 10 with light, lamps of the lamp part 80 are sequentially driven by the inverter 70 in order to reduce power consumption and to reduce motion blur of the LCD panel 10.

The lamp part 80 includes a plurality of lamps 80*a*, . . . , 80*n* arranged parallel with each other under the LCD panel 10 as shown in FIG. 2. The lamp part 80 may employ a cold cathode fluorescent lamp (CCFL) or an external electrode fluorescent lamp (EEFL) as the lamps 80*a*, . . . , 80*n*.

The lamps 80*a*, . . . , 80*n* of the lamp part 80 are sequentially driven to reduce visibility deficiencies, such as motion blur, when the LCD panel 10 displays moving pictures. The lamps 80*a*, . . . , 80*n* of the lamp part 80 are turned on and turned off after a fixed time and in order, for example, in a sequence of an upper position to a lower position of the LCD panel 10. The lamp 80*a* is turned on first and the lamp 80*n* is turned on last. The lamp corresponding to a first gate line is driven first. The lamps 80*a*, . . . , 80*n* of the lamp part 80 are sequentially driven, so that the visibility deficiencies, such as motion blur, may be reduced and the overall power consumption may be reduced.

The lamp part 80 receives a lamp voltage VL and a lamp current IL from the inverter 70 to drive the lamps 80*a*, . . . , 80*n*.

The inverter control part 60 provides the inverter 70 with a lighting control signal I_CS to control a lighting time of the lamps 80*a*, . . . , 80*n* of the lamp part 80. When the inverter control part 60 receives the gate start pulse STV from the timing controller 30, the inverter control part 60 provides the inverter 70 with the lighting control signal I_CS.

The inverter 70 converts the input voltage VIN of direct current into an alternating-current voltage VS, boosts the alternating-current voltage VS to generate a lamp voltage VL, and provides the lamp part 80 with the lamp voltage VL. When the lamp voltage VL is applied to the lamp part 80, the lamp current IL is also applied to the lamp part 80.

Figure 3:
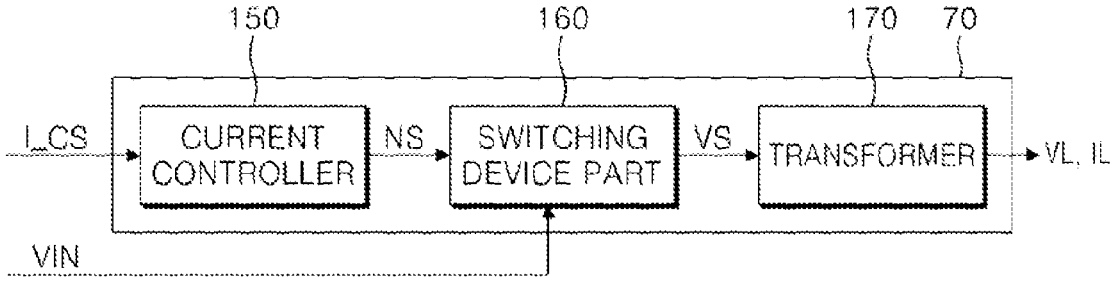
FIG. 3 is a block diagram illustrating an inverter in the LCD apparatus of FIG. 1.
Figure 4:
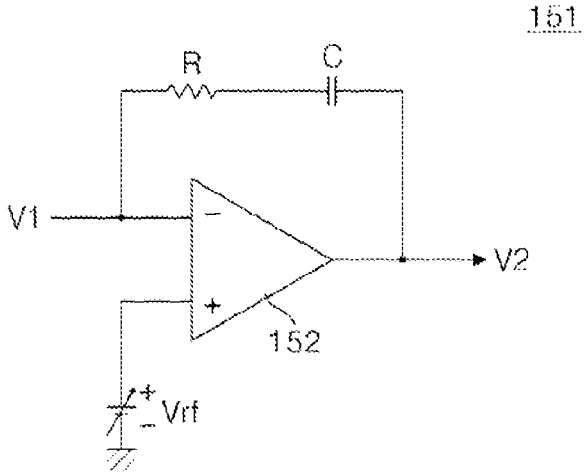
FIG. 4 is a circuit diagram showing a current control circuit in a current controller in the inverter of FIG. 3.
Figure 5:
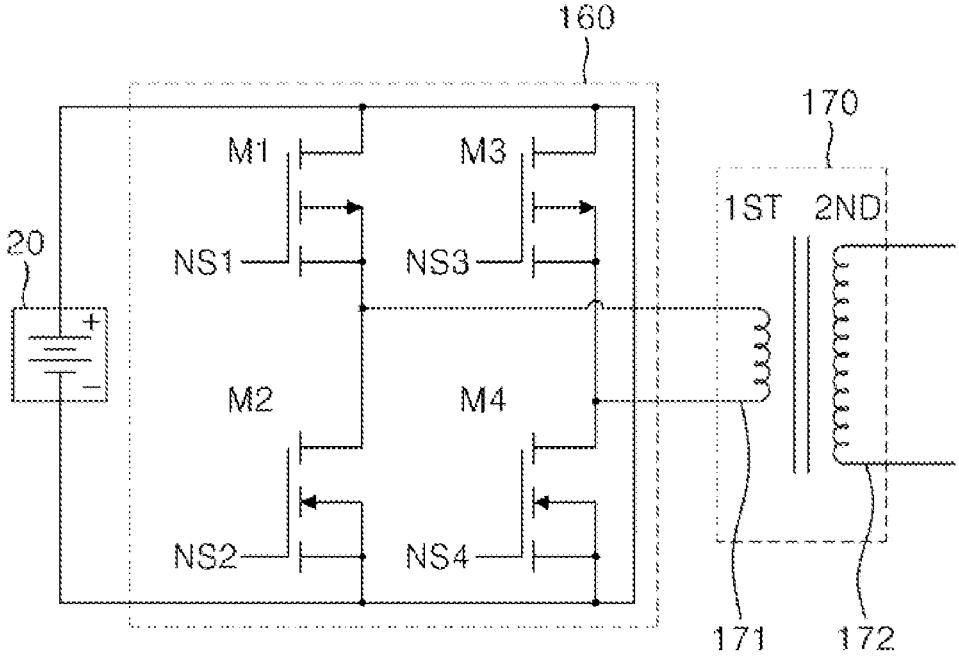
FIG. 5 is a circuit diagram showing a switching device part and a transformer in FIG. 3.

FIG. 3 is a block diagram illustrating an exemplary embodiment of the inverter 70 shown in the LCD apparatus of FIG. 1. FIG. 4 is a circuit diagram showing an exemplary embodiment of a current control circuit used in a current controller in the inverter of FIG. 3. FIG. 5 is an exemplary embodiment of a circuit diagram showing a switching device part and a transformer used in the inverter 70 shown in FIG. 3.

The inverter 70 provides the lamp part 80 with the lamp voltage VL and lamp current IL, which have a high frequency.

Referring to FIGS. 3, 4 and 5, the inverter 70 includes a current controller 150, a switching device part 160, and a transformer 170.

The current controller 150 generates a logic signal NS, based on the lighting control signal I_CS provided by the inverter control part 60 of FIG. 1, to provide the switching device part 160 with the logic signal NS. The current controller 150 includes a current control circuit 151, shown in FIG. 4, controlling currents applied to the transformer 170.

Referring to FIG. 4, after a voltage difference between an input voltage V1 and a reference voltage Vrf is fully charged at a capacitor C by inner offset of a comparator 152, output voltage V2 is stably outputted, as shown in FIG. 4. During the time that the offset voltage is charged to the capacitor C, the comparator 152 outputs a voltage, in a transient response state. When current is applied to an input terminal of the comparator 152, the current gradually increases in the transient response state as described above.

Additionally, a modulation part (not shown) may be formed at an output terminal of the current control circuit 151 shown in FIG. 4. The modulation part may use the current control signal I_CS as the logic signal NS. The logic signal NS is a signal that is modulated, for example, by pulse width modulation (PWM), and applied to the transistors M1, M2, M3, and M4 of the switching device part 160, shown in FIG. 5. Waveforms of currents that will be applied to a first coil 171 of the transformer 170 are controlled by the light control signal I_CS to have different respective peak currents in a transient response period and in a normal response period, according to the response characteristics of the current control circuit 151.

The switching device part 160 includes switching devices such as metal-oxide semiconductor field effect transistors (MOSFETs), which are connected with each other in a full bridge type, to convert the input voltage VIN of a direct-current voltage into an alternating-current voltage. The switching device part 160 may include MOSFETs of N-type or MOSFETs of P-type. For example, the switching device part 160 may employ the P-type MOSFETs as first and third transistors M1 and M3, and the N-type MOSFETs as second and fourth transistors M2 and M4.

Alternatively, all of the first to fourth transistors M1 to M4 may be formed by the P-type MOSFETs or the N-type MOSFETs.

When the first to fourth transistors M1 to M4 are turned on/off according to the logic signal NS provided by the current controller 150, the switching device part 160 may periodically change the direction of current flowing through the first coil 171 of the transformer 170. When the direction of current flowing through the first coil 171 of the transformer 170 is periodically changed, the lamp current IL of alternating current is induced in a second coil 172 of the transformer 170.

As described above, the lamp voltage VL is induced in the second coil 172 of the transformer 170 by the alternating-current voltage VS of the first coil 171 of the transformer 170. The first coil 171 of the transformer 170 is electrically connected to the switching device part 160, and the second coil 172 of the transformer 170 is electrically connected to the lamp part 80. The transformer 170 boosts the alternating-current voltage VS of the first coil 171 to generate the lamp voltage VL according to the turn ratio of the first coil 171 to the second coil 172. The lamp voltage VL of the second coil 172 is applied to the lamp part 80. Additionally, the lamp current IL is induced at the second coil 172 due to the alternating currents of the first coil 171, and the lamp current IL is applied to the lamp part 80.

For example, when the voltage applied to the first coil 171 is about 24 V, the voltage induced at the second coil 172 may be hundreds or thousands of volts according to the turn ratio of first coil 171 to the second coil 172.

Figure 6:
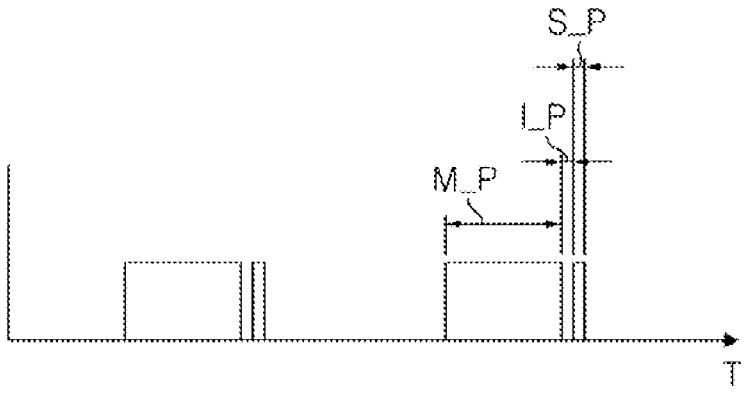
FIG. 6 is a timing chart showing an example of a lighting control signal outputted by an inverter control part in FIG. 1.
Figure 7:
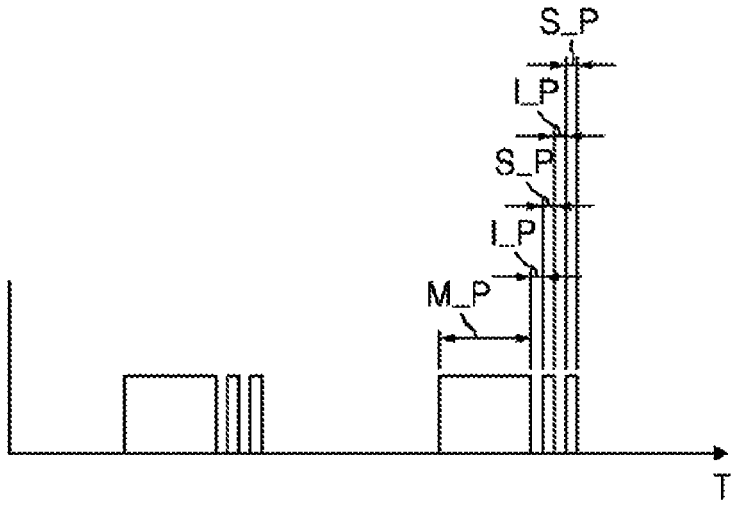
FIG. 7 is a timing chart showing another example of a lighting control signal outputted by an inverter control part in FIG. 1.

FIG. 6 is a timing chart showing an example of a lighting control signal output by the inverter control part 60, shown in FIG. 1, and FIG. 7 is a timing chart showing another example of a lighting control signal outputted by the inverter control part 60, shown in FIG. 1.

Referring to FIGS. 6 and 7, the lighting control signal having a square-wave shape is applied to the current controller 150 of FIG. 3, and the lighting control signal has a discontinuous square-wave shape, when the lamps are being turned off. The lighting control signal includes a main pulse M_P for providing maximum current during a lamp-lighting time of the lamps 80*a*, . . . , 80*n* of the lamp part 80, a silent period in which no input signal is applied after the main pulse M_P, and at least one discontinuous sub-pulse S_P just before a lamp turning-off time.

The main pulse M_P is provided to have a high level until the lamp is turned off. An output interval of the main pulse M_P is no shorter than 'the time of one frame/the number of lamps'. That is, the output interval of the main pulse M_P is inversely proportional to the number of lamps in the lamp part

80 of the LCD apparatus. Therefore, as the number of lamps increases, the pulse width of the main pulse M_P decreases. For example, when the LCD apparatus is operated at 60 Hz and the LCD apparatus has four lamps, the output period of the main pulse M_P is no shorter than 16.67 miliseconds (ms)/4=4.1675 ms. When the output period of the main pulse M_P is shorter than 4.1675 ms, each of the lamps may be turned off when the lamp is instantaneously lighted, so that entire luminance of the LCD panel may be lowered.

The sub pulse S_P has a shorter pulse width than the main pulse M_P when each lamp is turned off.

The silent period I_P has a time interval of about 50 microseconds (μs) to about 200 μs, and the sub-pulse S_P has a pulse width of about 50 microseconds (μs) to about 200 μs.

For example, when the time interval of the silent period I_P and the pulse width of the sub-pulse S_P are shorter than 50 μs, a peak value of the currents provided to the lamp rapidly decreases, so that noise of the transformer is not prevented. When the time interval of the silent period I_P and the pulse width of the sub-pulse S_P are greater than 200 μs, the output period of the sub-pulse S_P becomes longer, so that the peak value of the currents provided to the lamp rapidly decreases at a falling edge of the sub pulse S_P. As a result, the noise of the transformer is not prevented.

A plurality of sub-pulses S_P may be provided as shown in FIG. 7. In this case, the silent period I_P is interposed between the sub-pulses S_P. The time interval of the silent period I_P and the pulse width of the sub pulse S_P are set to be in the range of about 50 microseconds (μs) to about 200 μs.

Figure 8:
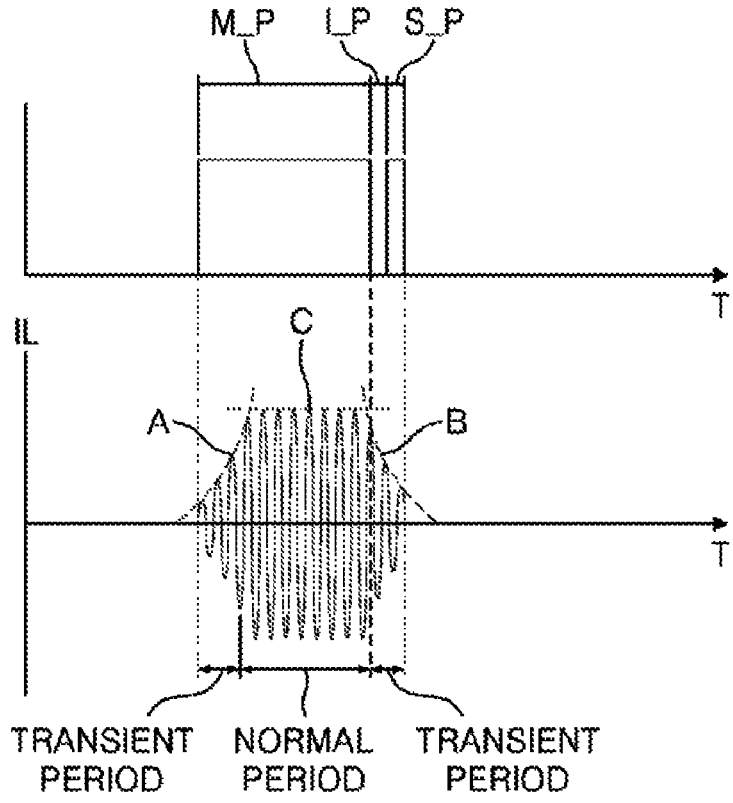
FIG. 8 is a waveform diagram showing currents outputted from the transformer of the inverter when the lighting control signal is applied to the current controller shown in FIGS. 3 and 4.

FIG. 8 is a waveform diagram showing currents outputted from the transformer 170 of the inverter 70 when the lightening control signal is applied to the current controller 150, shown in FIGS. 3 and 4.

Referring to FIG. 8, when the main pulse M_P of the lighting control signal is applied to the current controller at the beginning, a peak value of currents gradually increases along a response curve A of the transient response period. Then, the peak value of currents becomes uniform as a response curve C of the normal response period after a specified time passes. Then, when the silent period I_P passes and the sub-pulse S_P is applied, the peak value of currents gradually decreases along a response curve B of the transient response period.

When the main pulse M_P is ended, the silent period I_P passes and then the sub-pulse S_P is applied. Therefore, the peak value of currents does not abruptly decrease, but gradually decreases as shown in the transient response period B of FIG. 8, so that an abrupt change of the currents of the transformer is prevented.

Figure 9:
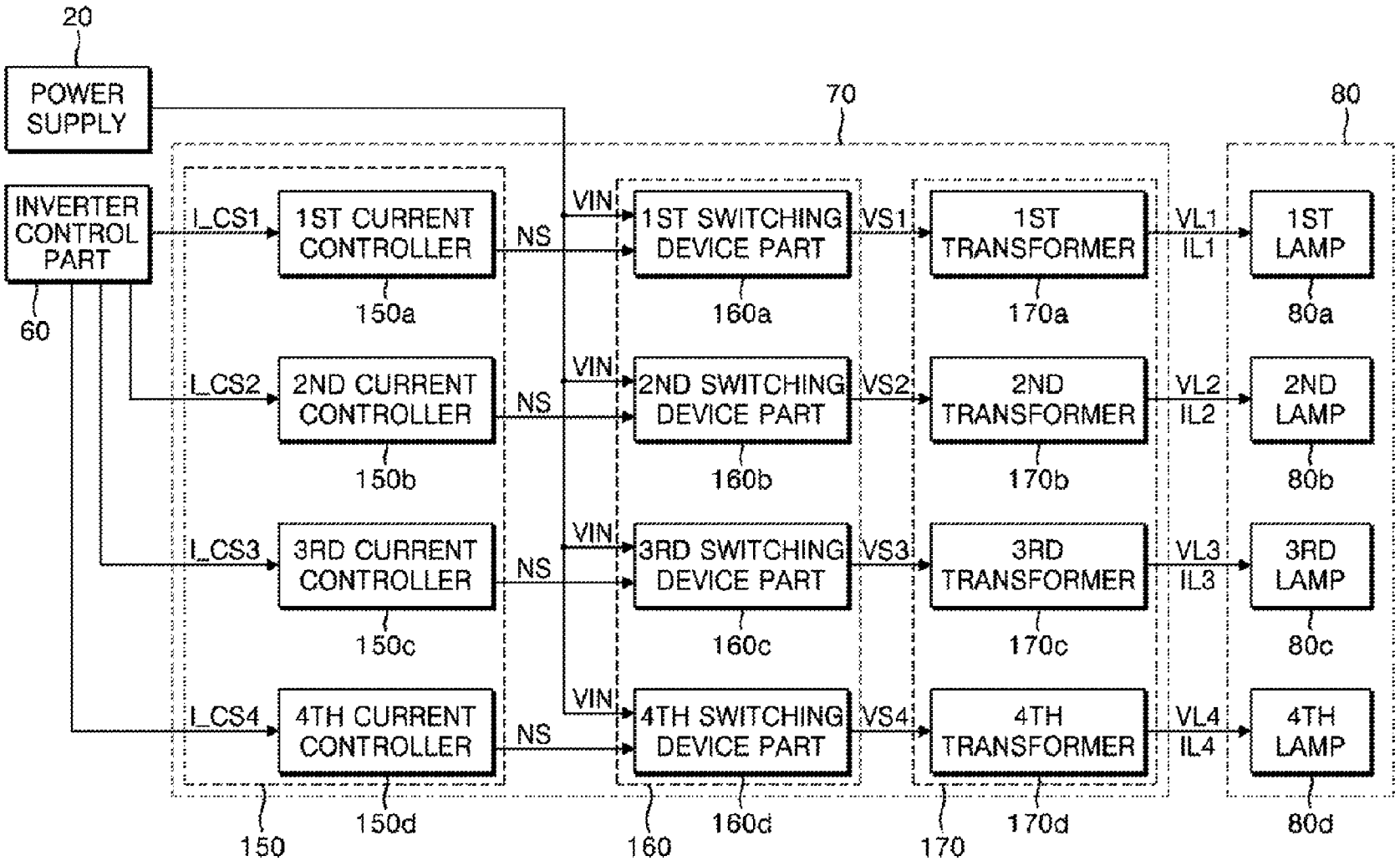
FIG. 9 is a block diagram illustrating an exemplary embodiment of an LCD apparatus employing four lamps and four inverters electrically connected to the four lamps, respectively.
Figure 10:
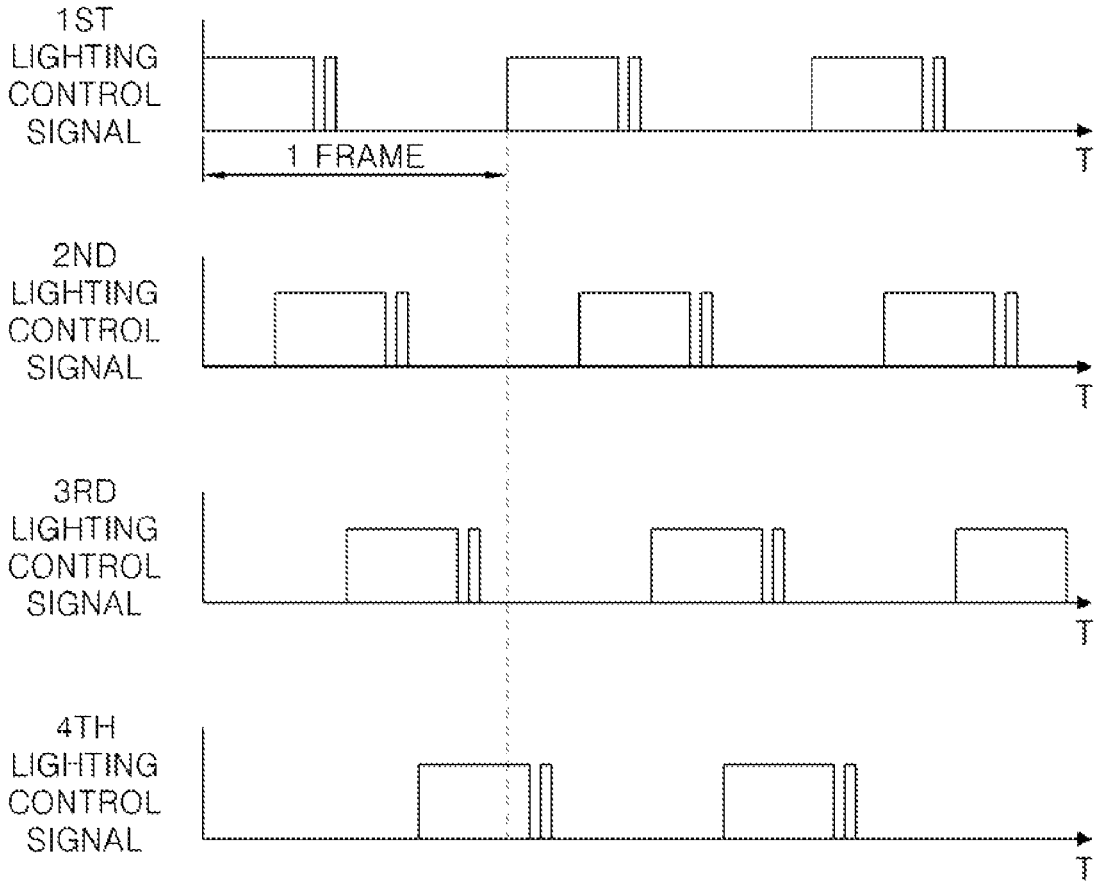
FIG. 10 is a waveform diagram showing four lighting control signals respectively applied to the four lamps shown in FIG. 9.
Figure 11:
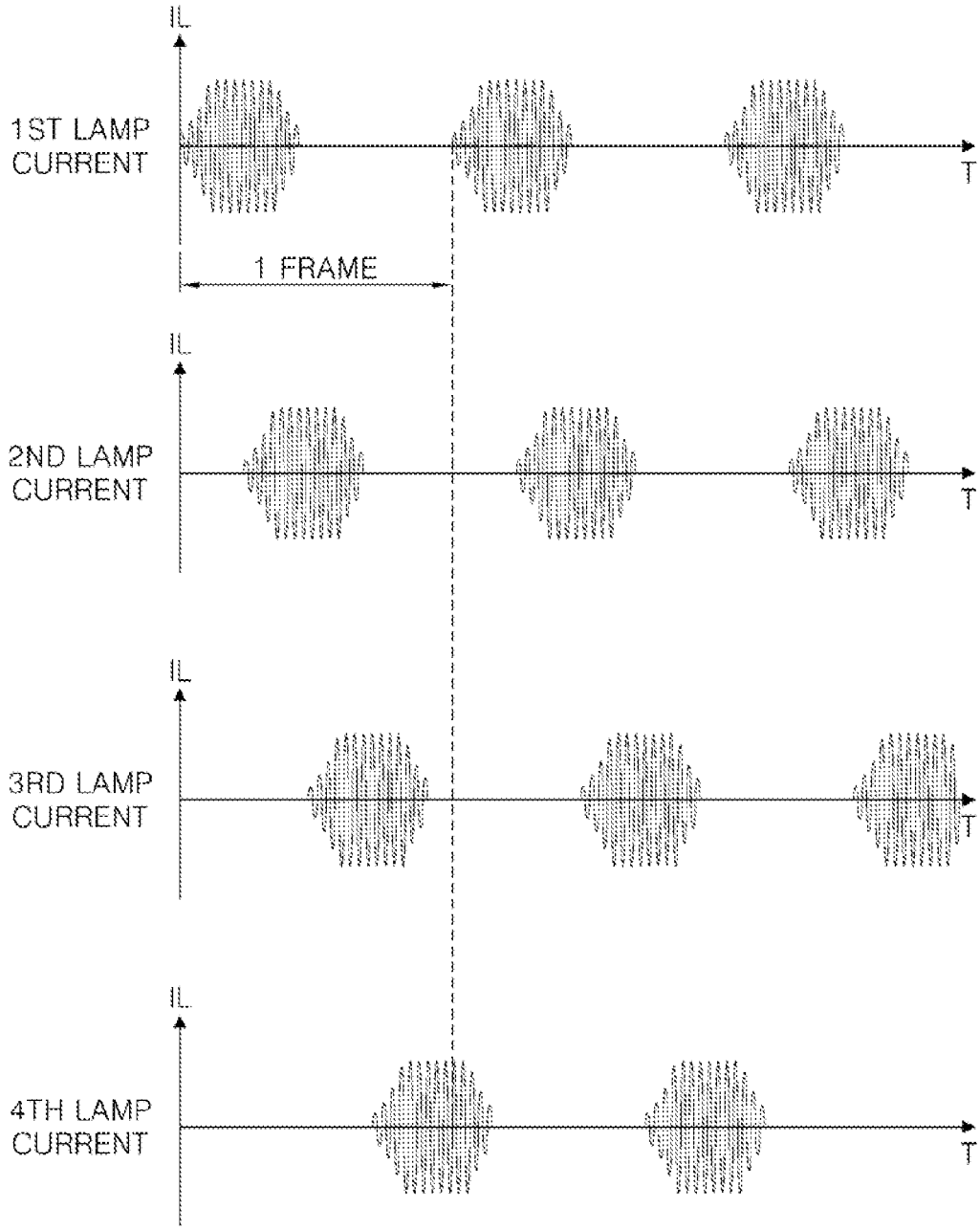
FIG. 11 is a waveform diagram showing current waveforms of the transformer when the four light control signals in FIG. 10 are applied to the LCD apparatus shown in FIG. 9.

FIG. 9 is a block diagram illustrating an LCD apparatus according to an exemplary embodiment of the present invention employing four lamps and four inverters electrically connected to the four lamps, respectively. FIG. 10 is a waveform diagram showing four lighting control signals respectively applied to the four lamps in FIG. 9. FIG. 11 is a waveform diagram showing current waveforms of the transformer when the four lighting control signals in FIG. 10 are applied to the LCD apparatus shown in FIG. 9.

Referring to FIGS. 9, 10, and 11, in order to sequentially drive the first, second, third, and fourth lamps 80*a*, 80*b*, 80*c*, and 80*d*, first, second, third, and fourth transformers 170*a*, 170*b*, 170*c*, and 170*d* for respectively providing the first to fourth lamps 80*a* to 80*d* are provided. The first to fourth transformers 170*a* to 170*d* are respectively connected to first, second, third, and fourth switching device parts 160*a*, 160*b*, 160*c*, and 160*d*. The first to fourth switching device parts 160*a* to 160*d* control currents IL1, IL2, IL3, and IL4 applied respectively to the first to fourth transformers 170*a*, 170*b*, 170*c*, and 170*d* by first, second, third, and fourth current controllers 150*a*, 150*b*, 150*c*, and 150*d*, respectively. The first, second, third, and fourth current controllers 150*a* to 150*d* apply first to fourth logic signals NS to the first to fourth switching device parts 160*a* to 160*d* in response to first, second, third, and fourth lighting control signals I_CS1, I_CS2, I_CS3, and to I_CS4, respectively, provided by the inverter control part 60. The first to fourth switching device parts 160*a* to 160*d* convert the input voltage VIN provided by the power supply 20 into first, second, third, and fourth alternating-current voltages VS1, VS2, VS3, and VS4 based on the logic signals NS to provide the first to fourth transformers 170*a* to 170*d* with the first to fourth alternating-current voltages VS1 to VS4.

When the first to fourth lighting control signals I_CS1 to I_CS4 are sequentially applied to the first to fourth lightening control signals I_CS1 to I_CS4 as shown in FIG. 10, the first to fourth transformers 170*a* to 170*d* output first to fourth currents IL as shown in FIG. 11.

In this exemplary embodiment, the first lighting control signal I_CS1 for controlling a lighting time of the first lamp 80*a* may overlap with the second lighting control signal I_CS2 for controlling a lighting time of the second lamp 80*b*. The fourth lighting control signal I_CS4 for controlling a lighting time of the fourth lamp 80*d* is applied before a next frame starts. The fourth lamp 80*d* may generate light even when the first lamp 80*a* is lit at the next frame.

While the exemplary embodiments of the present invention and their advantages have been described in detail, it should be understood that various changes, substitutions and alterations may be made herein without departing from the scope of the invention.

Therefore, a technical range of the present invention should by limited by the claims, not by the specification.

What is claimed is:

1. A backlight unit comprising:

a plurality of lamps sequentially turned on; and an inverter providing the lamps with current, the inverter gradually reducing the current provided to the lamps to turn off the lamps; and an inverter control part outputting a lighting control signal for sequentially lighting the lamps:

wherein the inverter comprises:

a transformer boosting a voltage applied to the transformer to generate a boosted voltage, and providing the lamps with the boosted voltage;

a switching device part converting a direct-current input voltage into an alternating-current output voltage provided to the transformer; and a current controller receiving the lighting control signal and providing the switching device part with a logic signal to control the switching device, and wherein the lighting control signal comprises:

a main pulse providing the lamps with maximum currents;

a sub-pulse generated at a time point of extinguishing the lamps, the sub-pulse gradually decreasing current provided to the lamps; and a silent period disposed between the main pulse and the sub-pulse.

2. The backlight unit of claim 1, wherein the current controller comprises a current control circuit outputting a current, of which a peak gradually increases or decreases in a respective transient period, and of which the peak is uniform in a normal operating period.

3. The backlight unit of claim 1, wherein a time, during which the main pulse is provided, is inversely proportional to the number of lamps.

4. The backlight unit of claim 1, wherein a pulse width of the sub-pulse is shorter than a pulse width of the main pulse.

5. The backlight unit of claim 4, wherein the silent period and a time, during which the sub-pulse is provided, are in a range of about 50 microseconds (μs) to about 100 μs.

6. The backlight unit of claim 1, wherein lighting times of the lamps adjacent to each other are overlapped with each other.

7. A liquid crystal display (LCD) apparatus comprising:

an LCD panel;

a backlight unit providing the LCD panel with light, the backlight unit including a plurality of lamps sequentially turned on and an inverter providing the lamps with current, the inverter reducing the current provided to the lamps to turn off the lamps;

an inverter control part outputting a lighting control signal for controlling a lighting time of each of the lamps;

a gate driving part and a data driving part driving the LCD panel; and a timing controller providing the gate driving part and the data driving part with a gate control signal and a data control signal, respectively, wherein the inverter comprises:

a transformer boosting a voltage applied to the transformer to generate a boosted voltage, and providing the lamps with the boosted voltage;

a switching device part converting a direct-current input voltage into an alternating-current output voltage to providing the transformer with the output voltage; and a current controller receiving the lighting control signal and providing the switching device part with a logic signal, and wherein the lighting control signal comprises:

a main pulse providing the lamps with maximum currents;

a sub-pulse generated at a time point of extinguishing the lamps, the sub-pulse gradually decreasing currents provided to the lamps; and a silent period disposed between the main pulse and the sub-pulse.

8. The LCD apparatus of claim 7, wherein the gate control signal comprises a gate start pulse, the timing controller provides the inverter control part with the gate start pulse, and the inverter control part provides the inverter with the lighting control signal, synchronized with the gate start pulse.

9. The LCD apparatus of claim 7, wherein the silent period and a time, during which the sub-pulse is provided, are in a range of about 50 microseconds (μs) to about 200 μs.

10. The LCD apparatus of claim 7, wherein a time, during which the lighting control signal is provided, is inversely proportional to the number of lamps.

11. The LCD apparatus of claim 7, wherein the lamps are sequentially lighted, and each of the lamps is lighted at least once during one frame of the LCD panel.

12. A liquid crystal display (LCD) apparatus comprising:

an LCD panel;

a backlight unit providing the LCD panel with light, the backlight unit comprising a plurality of lamps and an inverter driving the lamps; and an inverter control part providing the inverter with a lamp lighting signal in order to sequentially drive the lamps, the inverter control part outputting the lamp lighting signal having a discontinuous square-wave shape for reducing currents provided to the lamps when the lamps are turned off, wherein the lamp lighting signal comprises a main pulse providing the lamps with maximum current and a sub-pulse generated at a time point of extinguishing the lamps, and a silent period disposed between the main pulse and the sub-pulse.

13. The LCD apparatus of claim 12, wherein the inverter generates a high-frequency current signal through the lamp lighting signal, the high-frequency current signal includes a transient response period of lighting, a normal response period and a transient response period of extinguishing, and a current waveform of the transient response period of lighting and a current waveform of the transient response period of extinguishing are symmetric with respect to each other.

* * * * *